United States Patent [19]

Laymaster

[11] Patent Number: 5,048,185

[45] Date of Patent: Sep. 17, 1991

[54] HAND ACTUATED NIPPERS

[76] Inventor: Larry A. Laymaster, 819 Factory Rd., Beavercreek, Ohio 45385

[21] Appl. No.: 574,761

[22] Filed: Aug. 30, 1990

[51] Int. Cl.[5] ..... B26B 17/00

[52] U.S. Cl. ..... 30/183; 30/198

[58] Field of Search ..... 30/183, 195, 298, 232, 30/28, 29, 360

[56] References Cited

U.S. PATENT DOCUMENTS

| | | | |
|---|---|---|---|
| 813,598 | 2/1906 | Sylvester . | |
| 1,178,323 | 4/1916 | Knox . | |
| 2,753,626 | 7/1956 | Bowers . | |
| 4,793,063 | 12/1988 | Ducret | 30/360 |

*Primary Examiner*—Douglas D. Watts
*Attorney, Agent, or Firm*—Jacox & Meckstroth

[57] ABSTRACT

A pair of circular cutting dies each has a sharp peripheral cutting edge surrounding a cavity, and a connecting pin extends through center holes within the dies to support each die for rotation. One projecting end portion of the pin has a cross hole receiving a key ring, and the opposite projecting end portion receives a cross pin pivotally supporting a thumb actuated cam lever for forcing the dies and cutting edges together to a cutting position against the biass of spring washers confined between the dies within the opposing cavities. The lever is movable between a die open position and a die locked position for holding the dies in a closed position.

13 Claims, 1 Drawing Sheet

HAND ACTUATED NIPPERS

BACKGROUND OF THE INVENTION

In the art of hand actuated cutting tools or clippers, lever operated nail clippers have been made in a variety of sizes and shapes, including nail clippers which retain the nail clippings, for example, as disclosed in U.S. Pat. No. 2,753,626. Nail clippers also have other uses, for example, they are frequently carried by fisherman for clipping or nipping a fishing line or a lead close to the knot on a fishing lure. It is also known to construct hand actuated cutting tools which cut or trim along a circular cutting edge, for example, as disclosed in U.S. Pat. No. 1,178,323 or along a part-circular cutting edge, for example, as disclosed in U.S. Pat. No. 813,598.

With the known hand actuated cutting-tools or clippers of the general type mentioned above, the opposing cutting edges or surfaces are movable between a retracted position define a space or gap therebetween and a closed position where the cutting edges engage each other or a cutting surface for cutting an article inserted into the ga between the cutting edges. However, once one of the cutting edges of the clipper becomes dull or damaged, it is necessary to resharpen the cutting edge or the clipper has no value. This is uneconomical in view of the cost of sharpening the clipper or replacing the clipper.

SUMMARY OF THE INVENTION

The present invention is directed to an improved hand actuated cutting tool or clipper which provides for selecting different cutting edge portions for cutting a flexible lead, string, line or filament or other similar article. The clipper of the invention is ideally suited for use by fishermen who produce artificial flies or other fishing lures, especially after attaching fishing lines to the lures when it is desirable to trim the end portion of the line close to the fishing lure or adjacent the knot securing the line to the lure. The clipping tool or clipper of the invention is also adapted to be carried in a person's pocket or in a fishing tackle box and can be conveniently held and actuated with one hand.

In accordance with the invention, the above features are provided by a pair of opposing circular cutting dies each having a center portion which receives an axially extending center pin to support the dies for relative rotation and for relative axial movement. The dies define opposing cavities and have opposing peripherally extending sharp cutting edges. A set of spring washers are confined within the opposing cavities to urge the dies axially apart on the center pin to a retracted or open position. One end portion of the center pin has a cross hole for loosely receiving a split key ring adapted to carry a series of keys, and the opposite end portion of the center pin defines a slot which receives a thumb actuated cam lever supported by a cross pin. When the cam lever is depressed inwardly towards the dies, the dies are forced towards a cutting position when the opposing sharp cutting edges engage each other for shearing the article inserted between the cutting edges while in their retracted open position. Each die is free to rotate on the connecting center pin to provide for selecting any portion of the peripheral cutting edge of each die and thereby select the sharpest opposing portions of the peripheral cutting edges of the dies.

Other features and advantages of the invention will be apparent from the following description, the accompanying drawing and the appended claims.

DESCRIPTION OF THE PREFERRED EMBODIMENT

Figures 1, 2, 3, 4, 5, 6, 7:
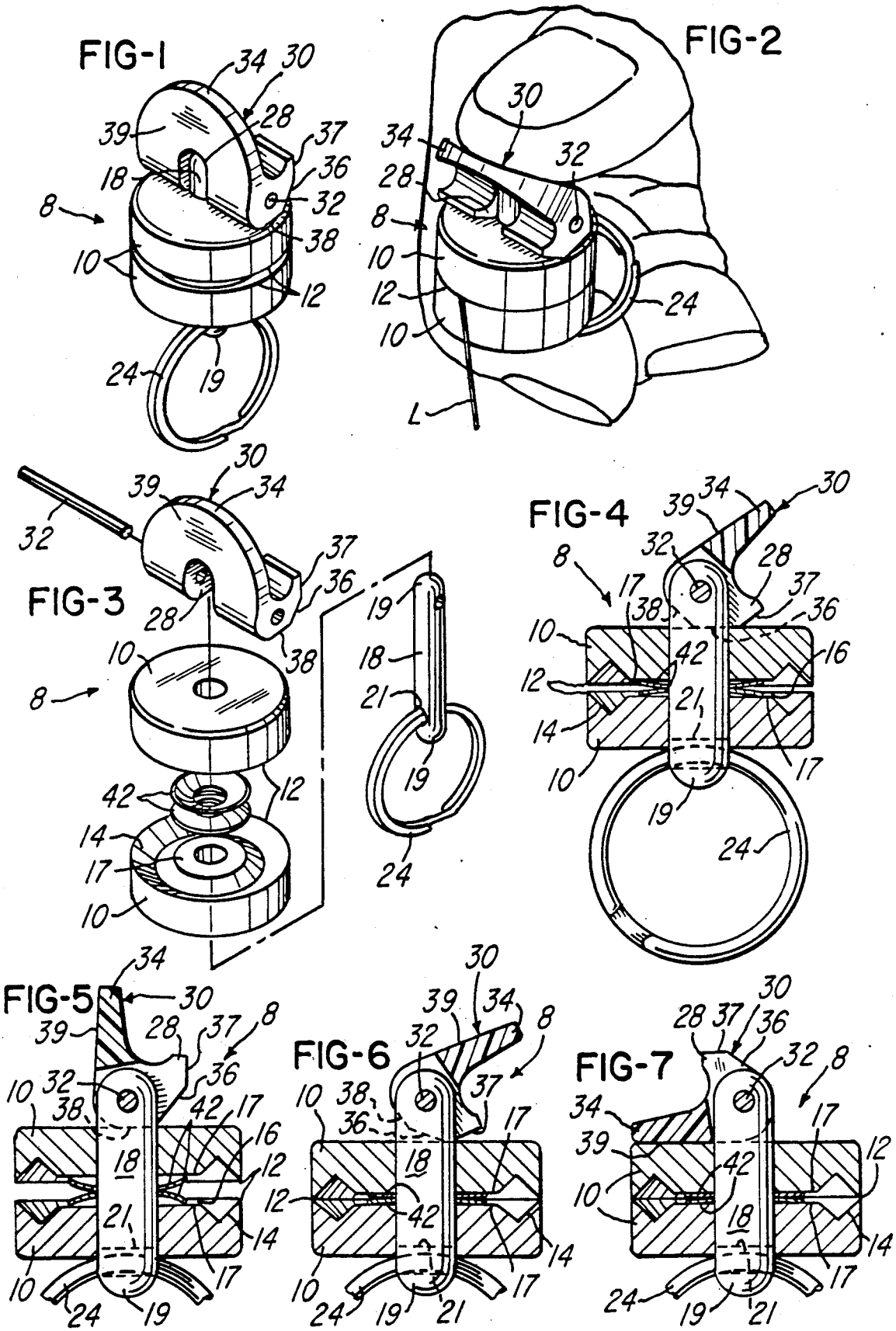
FIG. 1 is a perspective view of hand actuated cutting tool or clipper constructed in accordance with the invention.
FIG. 2 is another perspective view of the clipper and illustrating how it is gripped by a person's hand to actuate the clipper.
FIG. 3 is an exploded perspective view of the clipper shown in FIGS. 1 and 2.
FIG. 4 is an axial section of the clipper and showing the dies in a retracted position.
FIG. 5 is a view similar to FIG. 4 and showing the dies in their fully open position.
FIG. 6 is a view similar to FIG. 4 and showing the dies in their cutting position.
FIG. 7 is a view similar to FIG. 6 and illustrating the dies in their closed locked position for storage.

Referring to the drawing which shows a clipper 8 constructed in accordance with the invention, a pair of opposing circular steel cutting dies 10 each have a peripherally extending sharp cutting edge 12 formed by an annular groove 14 having a V-shaped radial cross-sectional configuration. The groove 14 of each cutting die connects with a cavity 16 defined by a recessed circular flat surface 17 located inwardly from the corresponding cutting edge 12. The opposing dies 10 are supported for rotation and relative axial movement by a steel guide pin 18 having opposite rounded end surfaces 19. A cross hole 21 is formed within one end portion of the pin 18 and receives a split metal key ring 24 adapted to support and carry a supply of keys (not shown). As shown in FIG. 4, the key ring 24 engages the outer surface of the lower cutting die 10 and forms a stop for the cutting die on the guide pin 18. The opposite end portion of the guide pin 18 projects into a slot 28 of a thumb actuated cam lever 30 pivotally supported by a cross pin 32 extending through aligned holes within the guide pin 18 and the cam lever 30

The cam lever 30 has a generally L-shaped configuration with a thumb engaging portion 34 having a set of flat surfaces 36, 37, 38 and 39. Preferably, the cam lever 30 is molded of a rigid plastics material to minimize weight and friction and to form the flat surfaces. However, the cam lever 30 may also be formed of metal. A pair of opposing Belville-type spring washers 42 are confined between the cutting dies 10 within the opposing cavities 16 and surround the guide pin 18 to engage the opposing recessed surfaces 17. The spring washers 42 normally urge the cutting dies 10 to a fully open position, as shown in FIG. 5.

When it is desired to use the clipper 8, a line or lead L (FIG. 2) or other article to be cut is inserted into the space or gap defined between the cutting edges 12 when the cutting dies are in their retracted position as shown in FIG. 4 or fully open position shown in FIG. 5. Pressure is then applied by the operator's thumb against the surface 39 of the cam lever 30 to force the dies 10 tightly together by collapsing the spring washers 42 and until the circular cutting edges 12 firmly engage each other in the closed or cutting position shown in FIG. 6. The cutting edges 12 cut or shear the article, and the trimmed or removed end portion of the article is retained within the opposing cavities 16 defined between the surfaces 17. When the cam lever 30 is depressed to move the dies 10 to their closed or cutting position (FIG. 6), the ridge portion of the cam lever as defined by the surfaces 36 and 37 presses inwardly or downwardly on the top cutting die 10 with a large mechanical advantage so that substantial closing force is applied to the cutting dies 10. The cutting dies 10 are returned to an open position (FIG. 4 or 5) by the spring washers 42 when the ca lever 30 is released.

If it is desired to maintain the cutting dies 10 in the closed position for storage, the cam lever 30 is pivoted to the position shown in FIG. 7 when the surface 39 on the lever 30 engages the flat outer or upper surface of the adjacent cutting die 10. When the cutting die 10 is returned to an open position (FIG. 4 or 5), the severed end portion of the lead or article is released from the cavities 16 so that it may drop from between the cutting dies.

From the drawing and the above description, it is apparent that a hand actuated cutting tool or clipper constructed in accordance with the present invention, provides desirable features and advantages. For example, the rotatable support of each cutting die 10 on the guide pin 18 provides for conveniently selecting the portion of each cutting edge 12 which provides the sharpest cut in the event that any portion of a cutting edge becomes less sharp due to extended uses. In addition, the inner cavities 16 defined within the cutting dies provide for trapping the trimmed portion of the article so that the portion may be retained and disposed of at a later time. While the cavities and surfaces 16 provide for using the spring washers 42 to separate the cutting dies 10 to their fully open position (FIG. 5), it is within the scope of the invention to define larger annular cavities and to use a compression coil spring in place of the spring washers 42. The cutting dies 10 may also be conveniently located at different positions simply by rotating the cam lever 30 between the fully open position (FIG. 5) when the surface 38 on the lever 30 engages the adjacent cutting die 10 and the closed position as shown in FIGS. 6 and 7.

While the form of hand actuated clipper o cutting tool herein described constitutes a preferred embodiment of the invention, it is to be understood that the invention is not limited to this precise form of cutting tool, and that changes may be made therein without departing from the scope and spirit of the invention as defined in the appended claims.

The invention having thus been described, the following is claimed.

1. A hand actuated cutting tool adapted for cutting a flexible line or other article, comprising a set of opposing cutting dies each having a center portion, at least one of said dies having means forming a peripherally extending sharp cutting edge and the other said die having an opposing cutting surface, a center pin connecting said center portions of said dies and providing for relative axial movement of said cutting dies between a retracted open position defining a gap between said cutting edge and said cutting surface and a closed position with said cutting edge engaging said cutting surface, said pin also supporting said dies for rotation for selecting portions of said cutting edge and said cutting surface, means including at least one spring member disposed between said dies and surrounding said center pin for biasing said dies to said retracted position, and means connected to said pin for moving said dies from said open position to said closed position for cutting the article inserted between selected portions of said cutting edge and said cutting surface.

2. A cutting tool as defined in claim 1 wherein at least one of said cutting dies is circular and has a circular said cutting edge defined by an annular recess within said die.

3. A cutting tool as defined in claim 1 wherein said center pin has opposite end portions projecting from said dies, and said means for moving said dies comprise a cam lever pivotally supported by one of said end portions of said pin.

4. A cutting tool as defined in claim 3 and including a key ring extending through a hole within the other said end portion of said pin adjacent said dies.

5. A hand actuated cutting tool adapted for cutting a flexible line or other article, comprising a set of opposing circular cutting dies each having a center portion, at least one of said dies having means forming a peripherally extending and circular sharp cutting edge and the other said die having an opposing cutting surface, a center pin connecting said center portions of said dies and providing for relative axial movement of said cutting dies between a retracted open position defining a gap between said cutting edge and said cutting surface and a closed position with said cutting edge engaging said cutting surface, said pin also supporting said dies for relative rotation for selecting different portions of said cutting edge and said cutting surface spring means disposed between said dies for biasing said dies to said retracted position, and a cam lever connected to said pin for moving said dies from said open position to said closed position for cutting the article inserted between selected portions of said cutting edge and said cutting surface.

6. A cutting tool as defined in claim 5 wherein said cam lever has multiple surfaces for positioning said cutting dies at said open and closed positions.

7. A cutting tool as defined in claim 5 wherein said spring means comprise a plurality of spring washers surrounding said center pin between said dies.

8. A cutting tool as defined in claim 5 wherein said cam lever has a surface for holding said dies at substantially said closed position.

9. A hand actuated cutting tool adapted for cutting a flexible line or other article, comprising a pair of opposing circular cutting dies each having a center portion, each of said dies having means forming a peripherally extending and circular sharp cutting edge, a center pin extending through said center portions of said dies and having opposite end portions projecting from said dies said pin providing for relative axial movement of said cutting dies between a retracted open position defining a gap between said cutting edges and a closed position with said cutting edges engaging each other, said pin also supporting said dies for relative rotation for selecting different portions of said cutting edges, spring means disposed between said dies for biasing said dies to said retracted position, means connected to one of said end portions and forming a stop for said dies, and a cam lever pivotally connected to the opposite said end portion of said pin for moving said dies from said open position to said closed position in response to pivoting said lever for cutting the article inserted between selected portions of said cutting edges.

10. A cutting tool as defined in claim 9 wherein said cam lever has multiple surfaces for positioning and holding said cutting dies at each of said open and closed positions.

11. A cutting tool as defined in claim 9 wherein said spring means comprise at least one spring washer surrounding said center pin between said dies.

12. A cutting tool as defined in claim 9 wherein said means forming said stop comprise a key ring.

13. A hand actuated cutting tool adapted for cutting a flexible line or other article, comprising a set of opposing cutting dies each having a center portion, at least one of said dies having means forming a peripherally extending sharp cutting edge and the other said die having an opposing cutting surface, a center pin connecting said center portions of said dies and providing for relative axial movement of said cutting dies between a retracted open position defining a gap between said cutting edge and said cutting surface and a closed position with said cutting edge engaging said cutting surface, said pin also supporting said dies for rotation for selecting portions of said cutting edge and said cutting surface, means for biasing said dies to said retracted position, means connected to said pin for moving said dies from said open position to said closed position for cutting the article inserted between selected portions of said cutting edge and said cutting surface, and said means for moving said dies include a cam lever having multiple surfaces for positioning said cutting dies at said open and closed positions.

* * * * *